US005613436A

United States Patent [19]

Taylor

[11] Patent Number: 5,613,436

[45] Date of Patent: Mar. 25, 1997

[54] VARIABLE POSITION PIN REGISTRATION PLATE FOR MULTICOLOR SILK SCREEN PRINTING APPARATUS

[76] Inventor: Richard E. Taylor, 1401 E. Green Willow La., Littleton, Colo. 80121

[21] Appl. No.: 503,094

[22] Filed: Jul. 17, 1995

[51] Int. Cl.[6] ..... B41F 15/04

[52] U.S. Cl. ..... 101/115; 101/126

[58] Field of Search ..... 101/114, 115, 101/123, 124, 126, 127.1, 129

[56] References Cited

U.S. PATENT DOCUMENTS

| | | | |
|---|---|---|---|
| 1,029,544 | 6/1912 | Horváth . | |
| 1,518,863 | 12/1924 | Lutz et al. . | |
| 2,244,272 | 6/1941 | Vollstorf | 101/115 |
| 3,460,470 | 8/1969 | Green et al. | 101/115 |
| 3,460,471 | 8/1969 | Green et al. | 101/115 |
| 4,040,352 | 8/1977 | Curti | 101/126 |
| 4,315,461 | 2/1982 | Harpold | 101/115 |
| 4,606,268 | 8/1986 | Jaffa | 101/115 |
| 4,679,501 | 7/1987 | Hanosh | 101/114 |
| 4,708,057 | 11/1987 | Hogenson | 101/129 |
| 5,094,160 | 3/1992 | Jennings | 101/129 |
| 5,094,161 | 3/1992 | Taylor | 101/129 |
| 5,127,321 | 7/1992 | Proffer | 101/126 |
| 5,188,026 | 2/1993 | Fuqua et al. | 101/129 |
| 5,483,882 | 1/1996 | Jaffa | 101/128 |

OTHER PUBLICATIONS

Diamond Chase Co. "The Revolution in Registration", Dec. 1993, 4–page brochure.

*Primary Examiner*—Ren Yan
*Attorney, Agent, or Firm*—John E. Reilly

[57] ABSTRACT

An adjustable pin registration plate assembly for use in a single or multiple station silk screen printing press apparatus which includes an apparel support platen mounted on an elongated support arm and at least one pivoting silk screen frame support assembly movably suporting a silk screen frame above the apparel support platen. The registration plate assembly comprises a flat plate portion having a plurality of pairs of spaced vertical bores therethrough and a pair of pins each extending upwardly from the plate portion through one of the bores and adjustably secured in the bore. The pair of pins fit into correspondingly spaced holes in the rear side of the silk screen frame to provide final alignment of the frame on the apparel support platen as the frame is lowered into position. The pins are adjustable in height above the plate portion to preclude binding during frame placement and removal from the apparel support platen.

20 Claims, 3 Drawing Sheets

VARIABLE POSITION PIN REGISTRATION PLATE FOR MULTICOLOR SILK SCREEN PRINTING APPARATUS

BACKGROUND AND FIELD OF INVENTION

This application generally relates to silk screen printing apparatus and more particularly to a novel and improved apparatus for aligning silk screen printing frames on an apparel support platen or shirt board.

There is a proliferation of T-shirt shops in this country and characteristically these shops specialize in custom work wherein a customer will make a specific request for a certain shirt design. It is virtually impossible for the small shops to carry a complete line of shirt designs and accordingly when a customer requests a particular shirt design, rather than to carry all of the shirts in stock, it is desirable to be able to imprint the design on the shirt while the customer waits. More and more, shirt designs are multi-colored but the silk screen equipment designed for such multi-color jobs is quite expensive and beyond the means and budget of most of the smaller shirt shops to carry such equipment and to be able to furnish custom printing services on site. Moreover, the multi-color printing systems now in use are quite bulky and occupy a fair amount of space so as not to be very practical for use in the smaller shops.

A particular problem associated with multi-color printing with silk screens is that the screens cannot be aligned accurately enough to permit successive placement of different screens over the same shirt or other article to perform multi-color jobs. In other words, unless each screen is accurately positioned and aligned with respect to the shirt and the preceding application of one color to the shirt, the different colored inks will tend to bleed or run together.

Of the various efforts made to solve this problem, U.S. Pat. No. 4,708,057 to T. C. Hogenson proposes to employ hinged brackets which clampingly engage a silk screen but is primarily concerned with multi-color wrap-around designs. In order to avoid the problem of accurate realignment between the different color patterns applied in succession to the article, Hogenson employs a printing platen having light-transmitting sections located in those areas where the edges of the article needing alignment will rest on the platen so that by directing light through those sections the operator can more accurately align and register the successive patterns applied.

U.S. Pat. No. 4,679,501 to A. L. Hanosh is also concerned with the problem of registration or proper alignment of the garment with respect to indicia to be printed on the garment, but Hanosh is concerned more with the proper positioning of a transparent sheet with respect to a silk screen.

U.S. Pat. Nos. 3,460,470 and 3,460,471 to M. E. Green et al disclose a method and apparatus for multi-color silk screen printing in which front and side guide pins are provided to establish proper registration of the article. U.S. Pat. No. 4,606,268 to D. Jaffa is directed to a multistation printing device similar to that of Hogenson; and U.S. Pat. No. 4,315,461 to C. W. Harpold uses the combination of hinged clamps and a counterweight to retain the screen in a particular position for multi-color printing. Also, Harpold provides for adjustable positioning of the distance between the print head and platen. Other representative patents are U.S. Pat. Nos. 1,029,544 to G. Horvath; 1,518,863 to A. H. Lutz et al and 2,244,272 to K. B. Vollstorf.

Diamond Chase Company of Huntington Beach, Calif. uses a registration plate which has spaced holes in it mounted to the silk screen in order to align the screen in the frame support clamping jaw. A fixed plate with correspondingly spaced holes is bolted to the shirt board support arm. The silk screen is aligned in the screen support clamping jaw by fitting a removable rod vertically through each set of aligned holes in the registration plate and the fixed plate on the support arm. The clamping jaw is tightened and the rods removed. This arrangement does not prevent side-to-side movement of the pivoting frame support assembly during subsequent printing operations.

A silk screen printing press which provides fixed registration pins to align the frames over the shirt board is disclosed in my U.S. Pat. No. 5,094,161. In order to overcome any binding of the registration pins in the silk screens, lift tabs are employed to engage the silk screen to lift it off the pins as the clamping plate is raised.

Accordingly, there remains a need for an improved assembly which eliminates side-to-side movement of the frame and ensures accurate placement of the frame over the apparel support platen repetitively and consistently without binding. There is also a need for a device which is adaptable for use both with conventional single and multistation presses and which can accommodate frames of different thicknesses and different hole spacings.

SUMMARY OF THE INVENTION

The pin registration plate assembly in accordance with the present invention meets the above mentioned needs.

It is therefore an object of the present invention to provide an improved pin registration plate assembly which is conformable for use with single and multiple station silk screen printing presses.

It is another object of the present invention to provide an improved pin registration plate assembly which has adjustable length pins to accommodate different thicknesses of silk screens to eliminate pin binding.

It is a still further object of the present invention to provide an improved pin registration plate assembly which accommodates frames having different pin spacings.

It is a still further object of the present invention to provide an improved pin registration plate assembly which is positionally adjustable independently of the silk screen clamping jaw or apparel support platen position.

It is a still further object of the invention to provide an improved drilling jig for placing accurate pin registration holes in silk screens for use with the improved pin registration plate assembly of the present invention.

The pin registration plate assembly in accordance with the present invention has been described for use in a silk screen printing press apparatus which includes an apparel support platen mounted on one end of a platen support arm, and a silk screen support movably carrying a silk screen above the platen is preferably positioned adjacent to the apparel support platen mounted on the platen support arm. The pin registration plate assembly includes a registration plate portion having a plurality of spaced vertical bores therethrough, a guide means extending downwardly from an underside of the plate portion for releasably engaging the support arm, and a pair of pins are slidably mounted in a pair of the bores for upward extension from the plate portion. These pins must protrude upwardly from the plate portion sufficiently to engage corresponding alignment holes in the silk screen as it is lowered onto the support platen. The pins must also not protrude into the holes so far as to cause binding of the pins in the holes when the frame is raised off of the apparel support platen. Accordingly, the assembly includes means for adjustably locking each of the pins in the bores so as to extend a predetermined distance into the silk screen alignment holes, and the pins are adjusted according to the thickness of the silk screens being used. The means for adjustably locking is preferably a locking handle disposed in a cross bore intersecting each vertical bore.

The registration plate assembly in accordance with the invention is adaptable for use with both conventional multistation printing and conventional single station printing presses. Both types of presses utilize an apparel support platen supported by a stationary support arm upon which the registration plate assembly may be mounted; and both have a pivoting silk screen support assembly to which the silk screens are interchangeably attached for raising, lowering and pressing the silk screen onto the platen. The principal difference between the printing presses is in the dimensions of the silk screen support assemblies utilized to hold the silk screens and guide placement of the frames onto and off of the apparel support platen. Different press manufacturers use frame clamp assemblies of different widths. The spacing of the registration pins must be sufficient to avoid interference with these clamps. Accordingly, different bore spacings for the removable registration pins are provided in the pin registration plate in accordance with the present invention.

The pin height in the assembly of the present invention is adjustable via the thumbscrews or locking handles. The optimum pin heights for a particular frame thickness can be determined in advance and, if several frame thicknesses are used in a multiple station press, the correct pin height can be quickly set to avoid pin binding during removal and placement of each silk screen on the apparel support platen.

A drilling jig for placing properly spaced holes in silk screens is particularly advantageous in use of the pin registration plate assembly of the invention. This jig basically includes a support platform or plate, a support block mounted along one edge of the plate, and a drilling plate mounted to the support block. The drilling plate is larger than the support block and contains a plurality of vertical bores with drill guide sleeves therein corresponding to desired registration pin spacings. The silk screen is placed on the support plate with one side centered under the drilling plate. The appropriate pairs of holes may then be drilled with a conventional hand drill through the appropriate guide sleeves.

The above and other objects, features and advantages of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
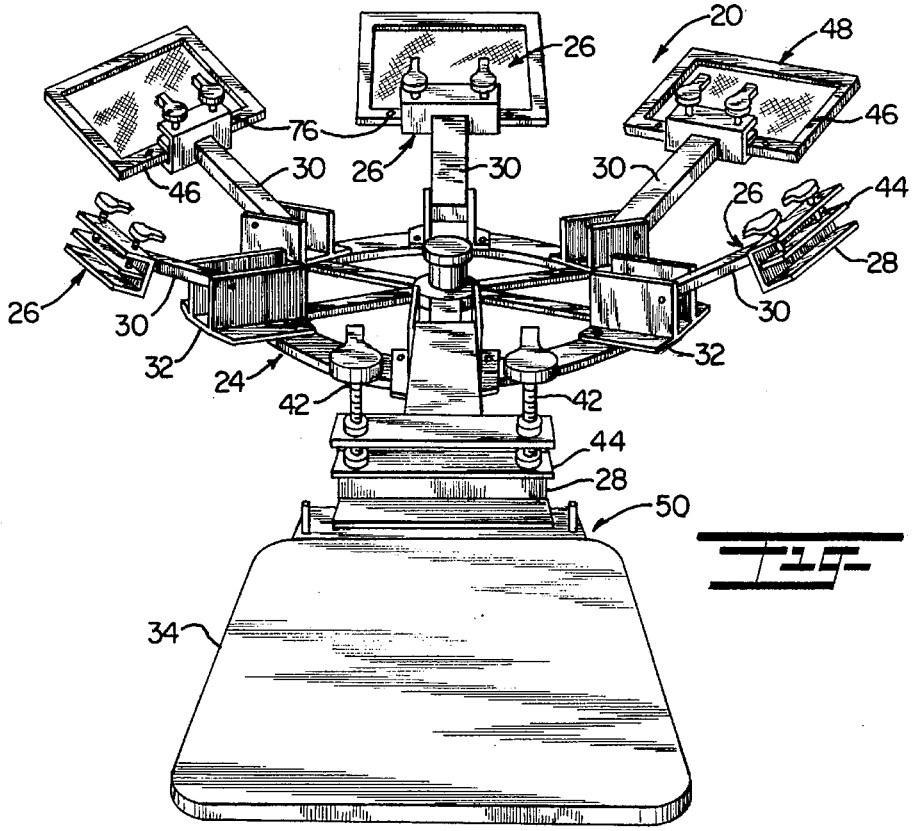
FIG. 1 is a perspective view of a multistation silk screen printing apparatus incorporating the pin registration plate in accordance with the invention.

Turning now to the drawings, a conventional multistation silk screen printing apparatus 20 is shown in perspective in FIG. 1 carrying the pin registration assembly in accordance with the present invention. The apparatus 20 comprises a stationary vertical spindle 22 secured to a support pedestal which may be floor or table mounted (not shown). A ring shaped rotary print head 24 is rotatably mounted on the spindle 22 for rotation of the head 24 about the central vertical axis of the spindle 22.

Figure 2:
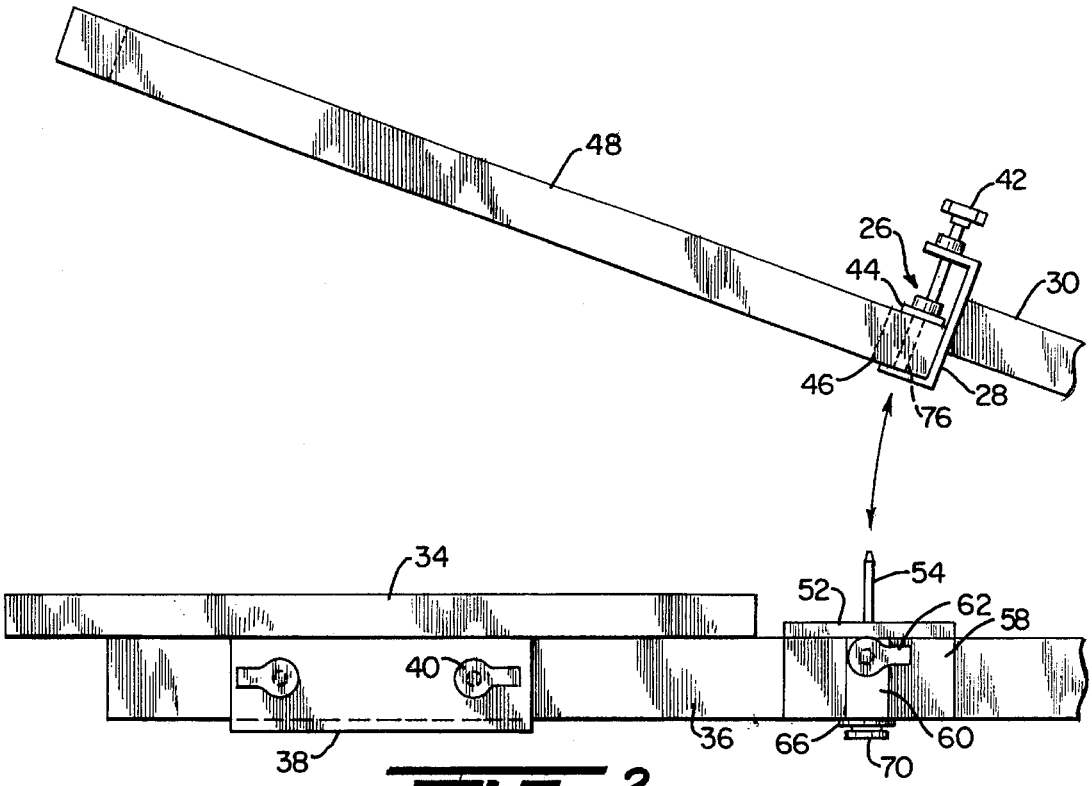
FIG. 2 is a partial side view of one of the support arms and the apparel support platen of the apparatus shown in FIG. 1.
Figure 3:
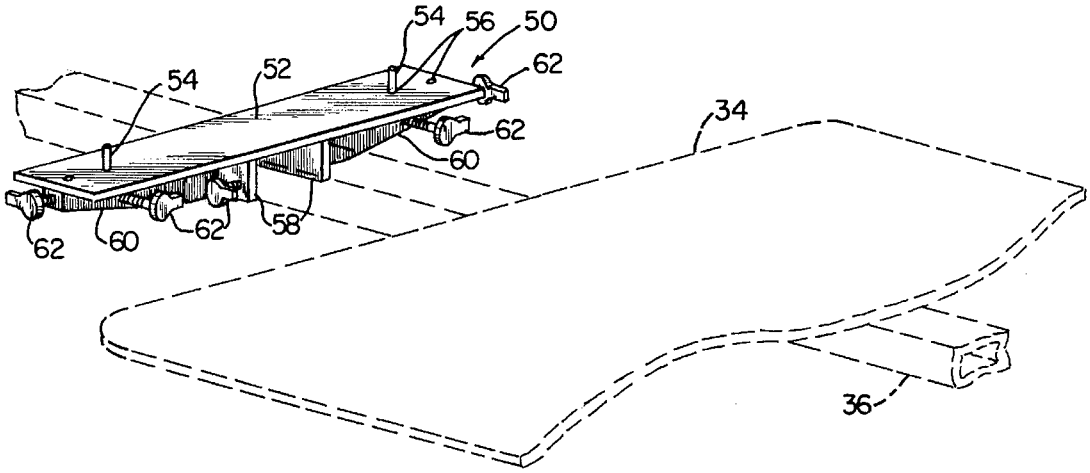
FIG. 3 is a perspective view of the pin registration plate in accordance with the present invention mounted on the support arm shown in FIG. 2.
Figure 4:
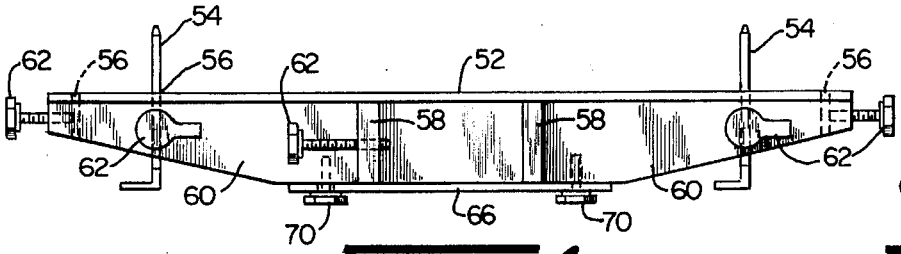
FIG. 4 is a side view of the pin registration plate in accordance with the invention.
Figure 5:
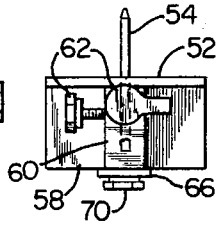
FIG. 5 is an end view of the plate shown in FIG. 4.
Figure 6:
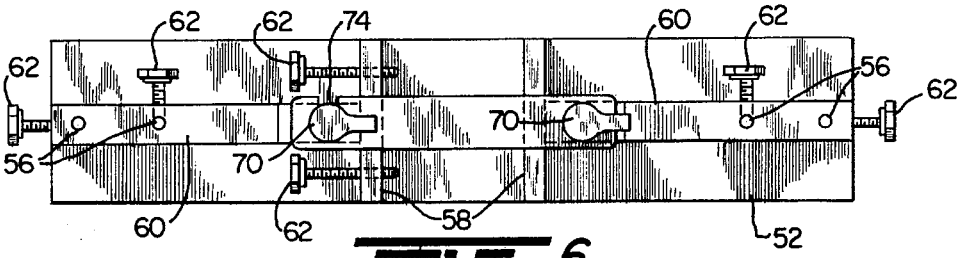
FIG. 6 is a bottom view of the plate shown in FIG. 4.

The print head 24 typically comprises a flat ring which supports six pivoting silk screen support assemblies 26 mounted at spaced intervals of about 60° around the head 24. Each silk screen support assembly 26 includes a clamping jaw 28 mounted on one end of a pivot arm 30 which has its other end pivotally mounted to a bracket 32 fixedly mounted on the print head 24. This bracket 32 also provides a mounting point for one end of a pair of counterbalancing springs (not shown) to bias the pivot arms upward, as shown in FIG. 1, when a silk screen is clamped in the clamping jaw 28. An apparel support platen 34, also known in the art as a "shirt board", is mounted on one end of a rigid support arm 36 which projects horizontally outward from the support pedestal beneath the rotary print head 24. The rigid support arm 36 is typically a tubular member which has its other end welded to the support pedestal of the apparatus 20. The platen 34 comprises a generally rectangular plate typically made of wood, metal, or fiberglass onto which an article of apparel is placed for silk screening. This platen 34 may be permanently mounted on the end of the support arm 36 or may preferably be adjustably mounted on the support arm 36 via a tubular or channel shaped member 38 which telescopically slides over and along the support arm 36, as shown in FIG. 2. The platen 34 may be secured in a desired position with set screws or bolts 40 through the channel shaped member 38 which engage the surface of the support arm 36.

Referring now to FIG. 2, a side view of the silk screen frame support assembly 26 is shown in a spring-biased raised position above the apparel support platen 34. The clamping jaw 28 of the silk screen support assembly 26 comprises an elongated piece of "C" shaped channel stock having a pair of spaced upper and lower parallel legs joined by a back preferably welded or otherwise fixed transversely to the outer end of the pivot arm 30. This clamping jaw 28 includes a pair of spaced clamping screws 42 threadably passing through the upper leg of the clamping jaw 28 to a clamping plate 44 extending the length of the clamping jaw 28.

One side portion 46 of a silk screen frame or screen 48 is clamped between the clamping plate 44 and the lower leg of the clamping jaw 28 via the clamping screws 42. The thickness of the side portions 46 of various size screens 48 will depend on the overall dimensions of the screens and the particular screen manufacturer.

It is imperative in the silk screen printing operation that each of the frame support assemblies 26 be capable of accurately positioning each screen 48 over the T-shirt or other piece of apparel mounted on the platen 34. This is achieved by mounting all of the support assemblies 26 for rotation about a single fixed spindle axis. However, any manufacturing tolerances and clearances in the press design become amplified as the radial distance from the spindle axis increases and may result in significant positioning errors. For this reason, the present invention provides an additional means of side-to-side alignment adjacent to the support platen 34 for accurate frame placement.

A variable position pin registration plate assembly 50 in accordance with the present invention, shown installed in FIGS. 1 and 2 and separately in FIGS. 3 through 6, is adjustably secured to the fixed support arm 36 adjacent to the apparel support platen 34 immediately beneath the clamping jaw 28. This registration plate assembly 50 includes a flat plate 52 slidably mounted in a plane parallel to the plane of the upper surface of the support platen 34 on the support arm 36. The plate 52 includes a pair of spaced pins 54 projecting vertically upward from the plate 52 and adjustably mounted in pairs of spaced vertical bores 56 on a centerline of the plate 52. The bores 50 are preferably spaced equally on either side of the centerline of the support arm 36.

The plate 52 is preferably a generally rectangular metal plate of aluminum or steel fixed to upper surfaces of a pair of vertical guide portions 58 which sandwich the support arm 36 therebetween so that the plate assembly 50 can slide along the support arm 36. A pair of vertical gusset members 60 extend outwardly between the vertical guide members 58 and the underside of the plate 52. Each of the pair of gusset members 60 is centered under the centerline of the plate 52 and fastened to the vertical guide member 58 and to the underside of the plate 52. The gusset members 60 provide lateral support to the vertical guide members 58 and provide rigidity to the overall registration plate assembly 50. Each vertical guide member 58 preferably includes a rectangular plate having one edge fixed to the underside of the registration plate 52. A pair of set screws 64 threadably pass horizontally through at least one of the vertical guide members 58 and engage with the support arm 36 to adjustably fix the plate assembly 50 to the support arm 36.

Each of the bores 56 passes vertically through the plate 52 and through a vertical portion of a gusset member 60. A threaded crossbore is provided through the gusset member 60 into each bore 56. This crossbore receives a set thumbscrew 62 which is used to releasably fix the position of each pin 54 in its bore 56. The position of the pins 54 in the bores 56 is adjustable to accommodate different sizes of silk screens 48 as will be subsequently described in more detail.

The spacing of the bores 56 in the plate 52 preferably coincides with the different registration pin spacings provided by various silk screen equipment suppliers such as Diamond Chase Co., Hix Corporation, and Sombie, Inc. In addition, other bore spacings may be provided based on specialized applications. For example, screens designed for use with single station presses may have 7¼ inch spacing between the holes. Screens designed for use in multistation presses may preferably have an 11 inch spacing between the holes 76 in order to avoid interference with the clamping jaw 28. Accordingly, the spacing between the bores 56 for the pins 54 in the registration plate assembly 50 in the illustrated embodiment are also preferably 7¼ inches and 11 inches.

A retaining bar 66 extends across the underside of the vertical guide members 58 to retain the assembly 50 on the arm 36. One end 68 of the bar 66 pivots via thumbscrew 70 mounted to the underside of one of the gusset members 60. The other end 72 of the retaining bar 66 has an open slot 74 for receiving the shaft of another thumbscrew 70 mounted in a threaded bore in the underside of the other gusset member 60. The retaining bar 66 slidably retains the assembly 50 on the arm 36 when both of the thumbscrews 70 are tightened against the bar 66.

The registration plate assembly 50 in accordance with the invention is particularly interchangeable between both multistation printing and single station designs because both utilize a stationary support arm for the apparel support platen upon which the registration plate assembly 50 may be mounted. The principal difference between the various printing apparatus designs is in the dimensions of the silk screen support assemblies utilized. Accordingly, several different pin bore spacings are provided in the plate 52 as above described. In addition, the adjustable pin height feature of the present invention is particularly advantageous where different screen thicknesses are encountered. The optimum height of the pins 54 is such that the pins 54 extend about halfway through the thickness of the screen 48 when the screen 48 is completely lowered onto the support platen 34. This partial penetration is employed to ensure alignment but not so far as to introduce pin binding upon lifting of the screen 48 off of the apparel support platen 34.

Another of the principal advantages of the present invention when used on a multistation press is that the pins 54 are located immediately adjacent to the support platen and enter the correspondingly spaced holes 76 in the silk screen 48 sufficiently to ensure accurate frame positioning with respect to the platen 34 consistently each time that a screen 48 is lowered the final inch or so over the platen 34. This eliminates any misalignment caused by side-to-side play in the pivoting frame and support arm.

A further advantage is that the plate assembly 50 can be interchangeably installed on single station printing presses as in my previous invention described in U.S. Pat. No. 5,094,161 and multiple station printing presses as shown in FIG. 1. In the former application, the pin registration plate assembly 50 replaces a fixed pin support member fastened to the fixed support arm, and the pins are placed in an appropriate inner set of spaced bores 56. In the latter case, the pins 54 would be placed in the outer set of bores 56 to avoid contact with the clamping jaw 28.

The multiple station press 20 shown in FIG. 1 is set up for silk screen printing as follows: in the claims. The rotary print head 24 is rotated to position a first frame support assembly 26 over the platen 34. The assembly 26 is lowered via pivot arm 30 to the platen 34 and a screen 48 is inserted into the clamping jaw 28.

Each screen 48 has a pair of spaced holes 76 through one edge 46. The spacing of the holes 76 is identical to the spacing between the pins 54 in the registration plate 52 and are drilled with the aid of the jig 100 illustrated in FIGS. 7 through 12 and described in more detail below.

The screen 48 is positioned in the clamping jaw 28 so that the pins 54 fit into the holes 76. The clamping screws 42 are then tightened to clamp the edge portion 46 of the screen 48 between the clamping plate 44 and the lower leg of the jaw 28.

The pivot arm 30 is raised and the next frame support assembly 26 is rotated into position over the platen 34 and the clamping process repeated with a new screen 48. When completed, each pivot arm 30 will have a silk screen 48 securely fastened in its frame support assembly 26.

In the printing operation, the rotary print head 24 is indexed to position each pivot arm 30 into position above the fixed support arm 36 and the platen 34 in sequence. Each screen 48 will automatically be positioned accurately over and will be accurately guided onto the apparel support platen 34 by the pins 54 as the pivot arm 30 is lowered.

The movement of the screen 48 onto and off of the pins 54 is through a small arc and therefore is almost linear in a vertical direction. However, if the pins 54 extend too deeply into the screen 48, the arcuate movement of the arm 30 may cause binding of the pins 54 in the holes 76. Accordingly, the height of the individual pins 54 in the registration plate assembly 50 is vertically adjusted so that they extend partially into but preferably not entirely through the holes 76 in the edge portion 46 of the screen 48 when mounted in the frame support assembly 26 and fully lowered onto the platen 34.

A drilling jig 100 for placing holes 76 in the edge portions 46 of silk screens 48 in accordance with the present invention is shown in FIGS. 7 through 12. The jig 100 includes a flat plate 102 which supports a rectangular drilling plate 104 mounted parallel to and spaced above the plate 102 and aligned along one edge of the plate 102. The rectangular plate 104 preferably bolts to or is otherwise fixed to the plate 102 adjacent one edge of the plate 102 through a support block 106 which spaces the drilling plate 104 above the plate 102 a sufficient distance to accommodate a silk screen 48 placed therebetween.

The drilling plate 104 is preferably centered between the lateral edges of the plate 102 and has a center mark 108 for aligning the center of the edge 46 of a screen 48 placed thereunder. The drilling plate 104 preferably has two pairs of spaced vertical drill guide sleeves 110 and 112 equally spaced from the center mark 108. The sleeves 110 and 112 are press fit or threadably inserted in vertical bores through the drill plate 104. These sleeves are designed to guide the drill bit of a hand drill D as shown in phantom in FIG. 8. The spacing between sleeves 110 and 112 are also preferably 7¼ inches and 11 inches in the illustrated embodiment.

Figure 7:
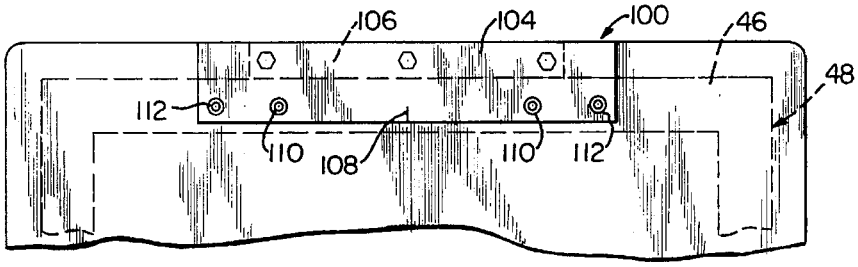
FIG. 7 is a partial plan view of a drilling jig for placing properly spaced holes in silk screens for use with the pin registration plate in accordance with the invention on one type of multistation apparatus.
Figure 9:
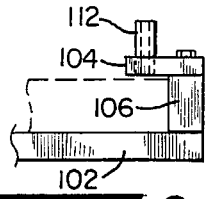
FIG. 9 is a partial side view of the jig shown in FIGS. 7 and 8.

In operation, a screen 48 is placed and centered on the plate 102 as shown in phantom in FIG. 7. The front edge 46 of the screen 48 abuts the support block 106 as shown in FIG. 9. A hand drill 114 is then alternately inserted into the appropriate sleeves 110 or 112 to drill the appropriate holes 76 in the edge 46 of the screen 48.

Figure 8:
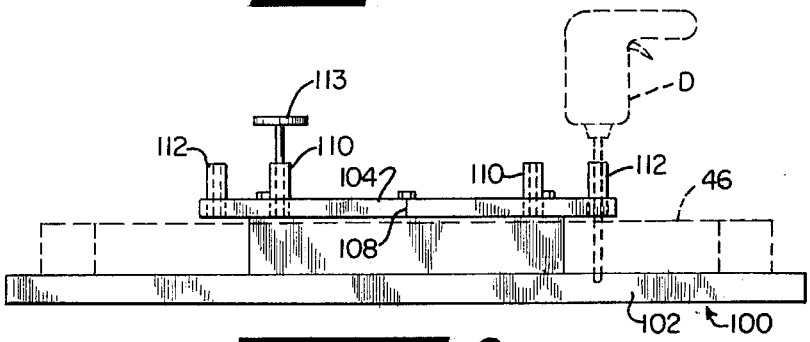
FIG. 8 is a front view of the jig shown in FIG. 7 showing a portable drill being used to drill the holes in the silk screen in phantom.

If the screen 48 already has a pair of holes 76 drilled in the edge 46 which are aligned with either guides 110 or 112, an aligning pin or rod 113 may be inserted in each of the predrilled holes 76 to more accurately set up the screen 48 for drilling another pair of holes of different spacing as is shown in FIG. 8.

Figure 10:
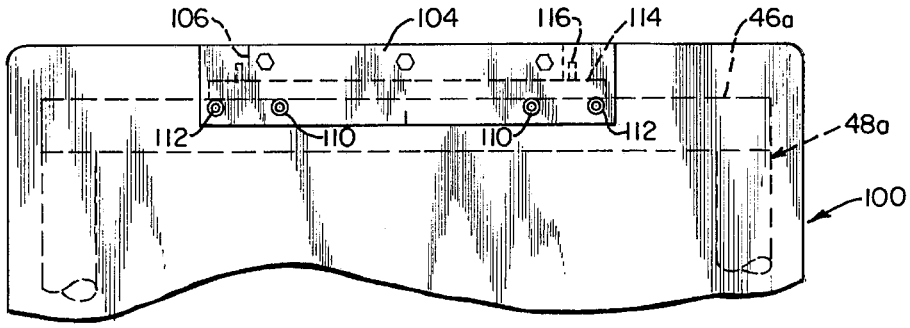
FIG. 10 is a plan view of the jig shown in FIG. 7 with a spacer bar installed for drilling spaced holes in the proper position for use with another type of multistation silk screen printing apparatus.
Figure 11:
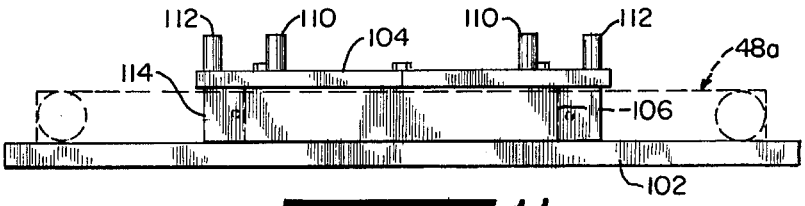
FIG. 11 is a front view of the jig shown in FIG. 10.
Figure 12:
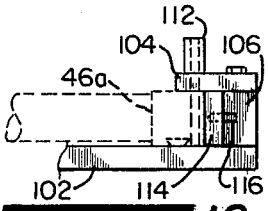
FIG. 12 is a partial rear side view of the jig shown in FIGS. 10 and 11.

Frames which have tubular sides may require a different alignment hole spacing from the rear edge of the frame side than frames with rectangular sides. Accordingly, a shim block 114 may also be used to position such a screen **48*a* slightly away from the support block 106 as is shown in FIGS. 10 through 12. This shim block 114 fits beneath the drill plate 104 and has spaced pins 116 positioned to sandwich the ends of the support block 106 therebetween and thereby center the shim block 114. The shim block 114 may be made in various thicknesses depending on the dimensions of the screens 48 or 48*a*** being drilled.

While the invention has been described with reference to preferred embodiments thereof, it is to be understood that various changes, alterations and modifications may be made which remain within the scope of the invention. For example, the gusset portion 60, the registration plate portion 52 and the guide plates 58 may all be part of a single unitary cast metal or molded body. Preferably the assembly 50 is made either of cast or machined steel or aluminum. However, a rigid and durable plastic may also be utilized. The gussets 60 between the guide plates 58 and the registration plate 52 may be in spaced pairs rather than a single centered gusset as shown. The registration plate, guide plates and gussets may also be machined or molded in a single piece of material or may be separate pieces bolted together.

The thumbscrews shown may also be replaced by spring loaded camming devices or other conventional mechanisms for clamping the assembly onto the support arm 36 or locking the pins 54 in place in the bores 56. Accordingly the present invention is intended to encompass all such variations, changes, and modifications that are within the broad scope and fair meaning of the following claims. All patents, patent applications, and other publications referenced herein are hereby incorporated herein in their entirety.

I claim:

1. A pin registration plate assembly for use in a single or multiple station silk screen printing press apparatus of the type having an apparel support platen mounted on an elongated support arm and a silk screen adapted to be carried above said platen by a movable frame support for placing said screen onto said platen, said assembly comprising a plate portion having a plurality of spaced vertical bores therethrough, guide means extending downwardly from said plate portion to releasably engage said support arm, locating pins mounted in a pair of said bores, each said pin extending upwardly from said plate portion for engaging correspondingly spaced holes in said screen, and means for adjustably locking each of said pins in position in said bores such that said pins extend a predetermined distance into holes in said screen whereby said screen is aligned with respect to said support platen when said screen is placed on said support platen.

2. The assembly according to claim 1, wherein said plurality of vertical bores are positioned along a centerline of said plate portion orthogonal to said elongated support arm.

3. The assembly according to claim 2, said guide means comprising a pair of spaced guide portions and a gusset portion between each of said guide portions and the underside of said plate portion.

4. The assembly according to claim 3, wherein each of said vertical bores passes through one of said gusset portions.

5. The assembly according to claim 4, wherein each of said gusset portions has at least one threaded crossbore extending into one of said vertical bores.

6. The assembly according to claim 5, further comprising an adjustable locking handle threadably inserted in each of said crossbores for engaging said pin to adjustably lock said pin in position.

7. The assembly according to claim 6, further comprising a gate member extending across said space between said guide portions to retain said assembly on said support arm of said press.

8. The assembly according to claim 6, wherein said gusset portions extend vertically beneath said centerline of said plate portion.

9. The assembly according to claim 8, wherein said plate, guide and gusset portions are portions of a single unitary metal body.

10. The assembly according to claim 8, wherein said plate, gusset, and guide portions are separate pieces fastened together.

11. In a silk screen printing press apparatus comprising an apparel support platen mounted on an elongated support arm and at least one movable silk screen support assembly adapted to carry a silk screen in said support assembly over said apparel support platen, said screen having a pair of spaced holes in one side thereof, the improvement comprising:

a pin registration plate assembly mounted on said support arm adjacent said platen including a flat plate portion having a plurality of pairs of spaced vertical bores therethrough, one of said pairs of bores correspondingly space to said pair of spaced holes in said screen, a pair of pins each extending upwardly from said plate portion for a predetermined distance into said holes to align said screen with respect to said support platen when said screen is placed on said support platen, and means for adjustably locking each of said pins in said bores such that said pins extend a predetermined distance into holes in said screen whereby said screen is aligned with respect to said support platen when said screen is placed on said support platen.

12. The assembly according to claim 11, wherein said plurality of vertical bores are placed along a centerline of said plate portion orthogonal to said elongated support arm.

13. The assembly according to claim 11, further comprising a pair of spaced guide portions extending downwardly from an underside of the plate portion slidably receiving said support arm therebetween, and means for removably securing said guide portions to said support arm adjacent said platen.

14. The assembly according to claim 13, further comprising a gusset portion between each of said guide portions and the underside of said plate portion.

15. The assembly according to claim 14, wherein each of said vertical bores passes through one of said gusset portions.

16. The assembly according to claim 15, wherein each of said gusset portions further comprises at least one threaded crossbore extending into one of said vertical bores.

17. The assembly according to claim 16, wherein said means for locking comprises an adjustable locking handle threadably inserted in each of said crossbores for engaging said pin to releasably lock said pin in position in said plate portion and said gusset portion.

18. The assembly according to claim 17, further comprising a gate bar having one end pivotally mounted to one of said guide portions and an opposite end extending across said space between said guide portions and removably secured to the other of said guide portions to retain said assembly on said support arm of said press.

19. The assembly according to claim 17, wherein said gusset portions extend vertically beneath a centerline of said plate portion orthogonal to said support arm.

20. The assembly according to claim 19, wherein said plate, guide and gusset portions are portions of a single metal body.

* * * * *